United States Patent [19]

Zebuhr

[11] 4,167,932

[45] Sep. 18, 1979

[54] DIVER HEATER SYSTEM

[75] Inventor: William H. Zebuhr, Nashua, N.H.

[73] Assignee: Energy Systems Corporation, Nashua, N.H.

[21] Appl. No.: 821,508

[22] Filed: Aug. 3, 1977

[51] Int. Cl.[2] ..... A61F 7/06

[52] U.S. Cl. ..... 126/208; 128/256; 431/344

[58] Field of Search ..... 126/204, 208; 165/46; 128/256, 402; 431/344

[56] References Cited

U.S. PATENT DOCUMENTS

| | | | |
|---|---|---|---|
| 2,989,049 | 6/1961 | Crouzet | 126/208 |
| 3,161,192 | 12/1964 | McCormack | 126/204 |
| 3,367,319 | 2/1968 | Carter, Jr. | 126/204 |
| 3,391,686 | 7/1968 | Wiswell, Jr. | 126/204 |
| 3,402,708 | 9/1968 | Grega | 126/204 |
| 3,402,709 | 9/1968 | Shivers et al. | 126/204 |
| 3,430,688 | 3/1969 | Crocker | 126/204 |
| 3,450,127 | 6/1969 | Harwood, Jr. | 126/204 |
| 3,513,824 | 5/1970 | Fitzgerald, Jr. | 126/204 |
| 3,536,059 | 10/1970 | Hearst et al. | 126/204 |
| 3,556,205 | 1/1971 | Harwood, Jr. | 126/204 |
| 3,583,386 | 6/1971 | Slack | 126/204 |
| 3,884,216 | 5/1975 | McCartney | 126/204 |
| 3,892,225 | 7/1975 | Twose | 126/204 |
| 3,894,213 | 7/1975 | Agarwala | 126/204 |

*Primary Examiner*—Ronald C. Capossela

[57] ABSTRACT

A heater system for warming the body of a diver while underwater, to be used in combination with and powered by an air supply tank is disclosed. In essence, the heater system functions by taking in controlled amounts of water from the ambient, heating this water and delivering it to the diver's suit.

High-pressure air from the air supply is admitted into the heater system through a pressure regulator which reduces the air pressure and utilizes the energy thus provided to operate as a pneumatic motor and water-circulating pump. The reduced-pressure air controls a fuel pressure regulator, allowing fuel, such as propane, to enter the system from a fuel canister. The air and fuel of controlled volume are permitted to mix and flow together into a catalytic combustion chamber where combustion is initiated by a spark generator. The circulating water passes through a heat-exchanging chamber surrounding the combustion chamber, absorbs the heat produced by the combustion reaction and is further pumped to the diver's suit.

10 Claims, 4 Drawing Figures

DIVER HEATER SYSTEM

BACKGROUND OF THE INVENTION

The present invention relates to apparatus for providing a warm water circulatory system for use in conjunction with diving suits and in particular to a heating system for warming the body of a diver while underwater.

The discomfort of a scuba-diver in cold water is obvious, and prolonged submersion in low-temperature conditions becomes intolerable. Even with moderate surface temperatures, the cold at lower depth represents a forbiddingly restrictive factor limiting the scope and freedom of the diver's range.

It is therefore a prime object of this invention to supply a heating system for providing warmth to a scuba diver's body while submerged.

It is a further object of this invention to provide a diver heating system which can be used in conjunction with conventional diving equipment and in particular in conjunction with the air supply from the scuba air tank both for its motive power and as a heating combustion medium.

Another object of this invention is to provide a diver heating system which is completely safe and free of any possibility of contaminating the diver's breathing air supply.

A still further object of this invention is to provide a diver heating system which is compact and easily portable.

These and other objects are fully realized in the present invention, as will become apparent from the ensuing sections of this specification.

SUMMARY OF THE INVENTION

The diver heater system herein described operates by taking in ambient cold water, heating it and delivering the warmed water to the diver's suit. This is accomplished by utilizing some of the high-pressure air from the diver's self-contained underwater breathing apparatus (scuba) air tank both to actuate a water-circulating pump and to serve as a combustion medium for fuel from an accompanying fuel tank. The heat of combustion of the fuel is transferred to the pump-circulated water.

High-pressure air from the scuba air tank's first stage regulator is carried by an umbilical line into the diver heater system's air regulator which combines the functions of a pneumatic motor and a positive displacement piston pump, consequently reducing the pressure of the incoming air. The resulting low-pressure air diffuses into the heater system, controlling a fuel intake regulator for introducing suitably proportioned amounts of fuel (e.g. propane). Both air and fuel pass through volume adjusting orifices into a common duct in which they mix and flow together into a catalytic combustion chamber, where ignition is initiated by a spark generator and combustion occurs. At the same time, the ambient water taken into the system is circulated by the positive displacement piston pump through a chamber surrounding the catalytic combustion chamber, heat exchange is accomplished, and the warmed water is pumped further through an umbilical line into the diver's suit. Provision is made for exhausting the products of combustion from the combustion chamber to the ambient water.

The diver heater system herein described may be used to deliver heated water to the diver in any one of the following three ways:

1. Open Loop: Water is drawn from the ambient, heated, delivered into the diver's wet suit. After being distributed over the diver's body through a perforated tube within the wet suit and circulated by the diver's swimming motions, the water is returned to the ambient.
2. Semi-Closed Loop: The bulk of the water delivered to the diver's wet suit is recirculated through an umbilical line back to the heater system. Water lost in the process is replaced by ambient cold water.
3. Closed Loop: A completely closed system is used, wherein the heated water is delivered to and passes through a tubulated garment worn by the diver inside a dry diving suit, then is recirculated through the heater system.

The following performance characteristics and dimensions offer a general idea of the capacity, effectiveness and compactness of the diver heater system: Using approximately 20 SCFH of air or helium-oxygen mixture from a scuba air tank at 125–145 psig to operate the water pump and a six-ounce canister of propane fuel, the system provides 1500 BTU per hour (435 thermal watts) in the form of heated water, with a fuel consumption rate of about 1.6 ounces of propane per hour. Thus, 3¾ hours of heating are available per fuel canister. At a water flow rate in the range of 0.3 gallons per minute through the system and at a depth of 30 feet, a water temperature increase of at least 10 degrees F. is achieved.

The entire diver heater unit, including the fuel canister but exclusive of the umbilical lines is about 3 inches in diameter, less than a foot long, and weighs in the range of two pounds. The unit therefore represents a relatively insignificant increase in the encumbrance of a scuba diver's equipment.

Preferred embodiments of the diver heating system, including the best mode now contemplated of carrying out the concepts of this invention, will now be described in full, clear and concise detail with reference to the accompanying drawings.

DESCRIPTION OF THE PREFERRED EMBODIMENTS

Figure 1:
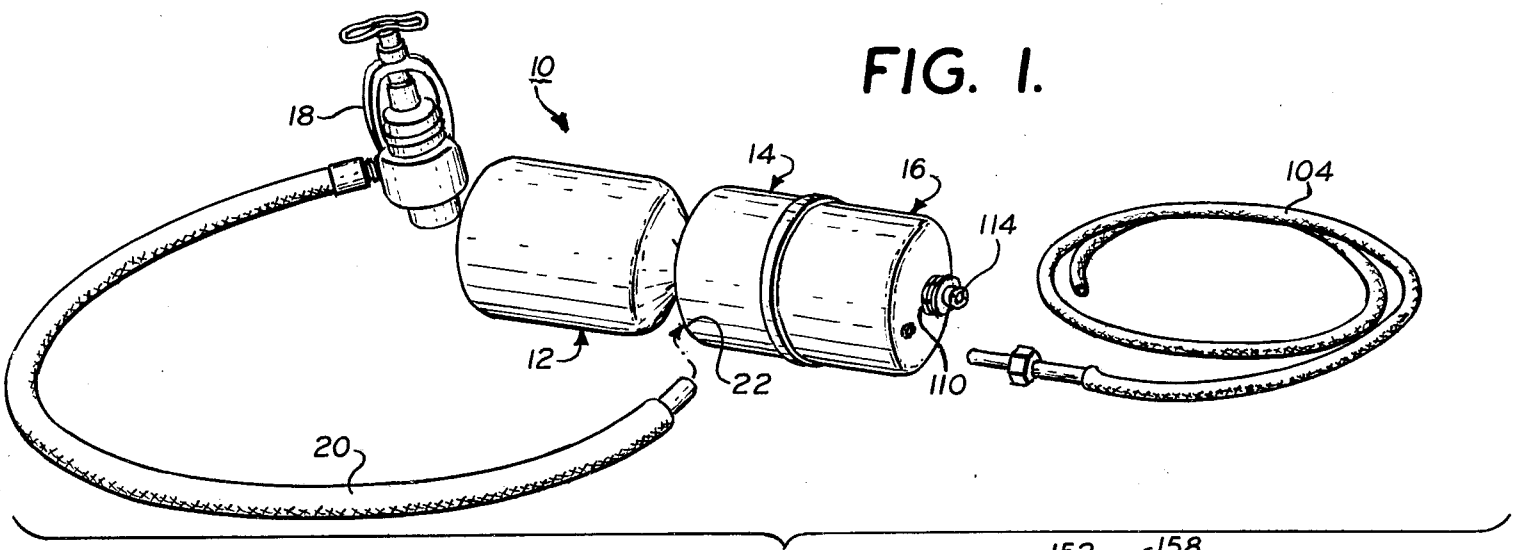
FIG. 1 is a perspective view of diver heater assembly constructed in accordance with this invention, with its associated umbilical connections shown in exploded relationship.
Figure 4:
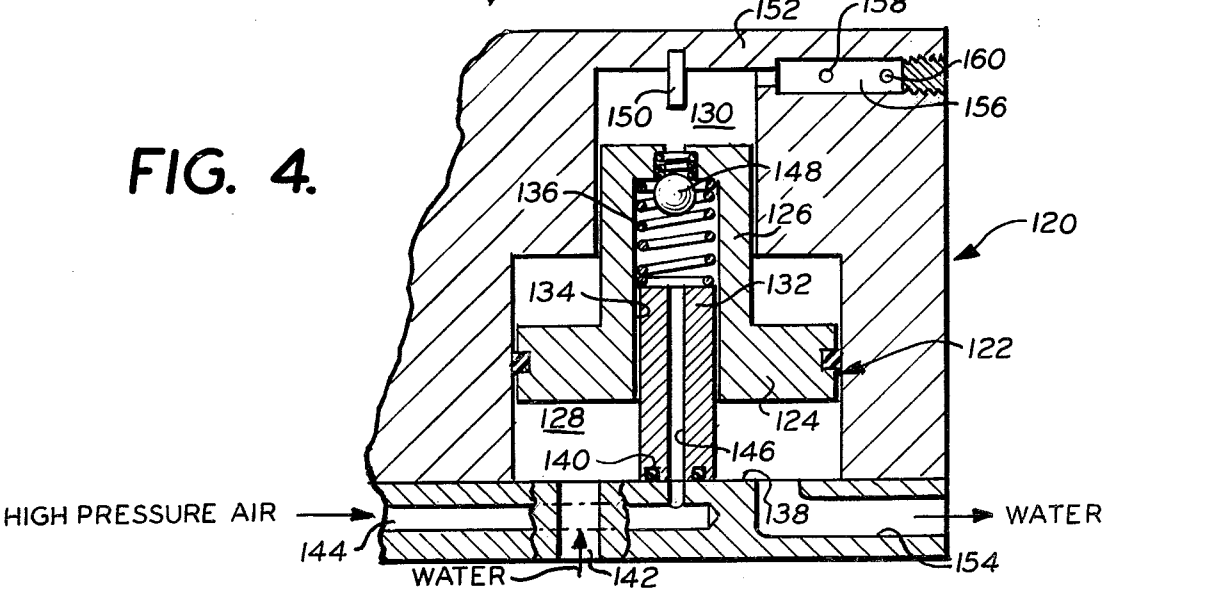
FIG. 4 is a partial cross-sectional view, illustrating another embodiment of the air-regulating positive displacement piston pump of this invention.

The diver heater assembly, generally referred to by the numeral 10, is shown in FIG. 1. It comprises three main sections: a fuel tank 12; a pre-heating section 14, where air, fuel and ambient water are admitted to the system, the air and fuel being regulated in pressure, controlled in flow volume and mixed, while the water is being circulated by punping; and a combustion chamber-heat-exchanger section 16, wherein the mixture is heated and from it is discharged into the diver's suit.

Figure 2:
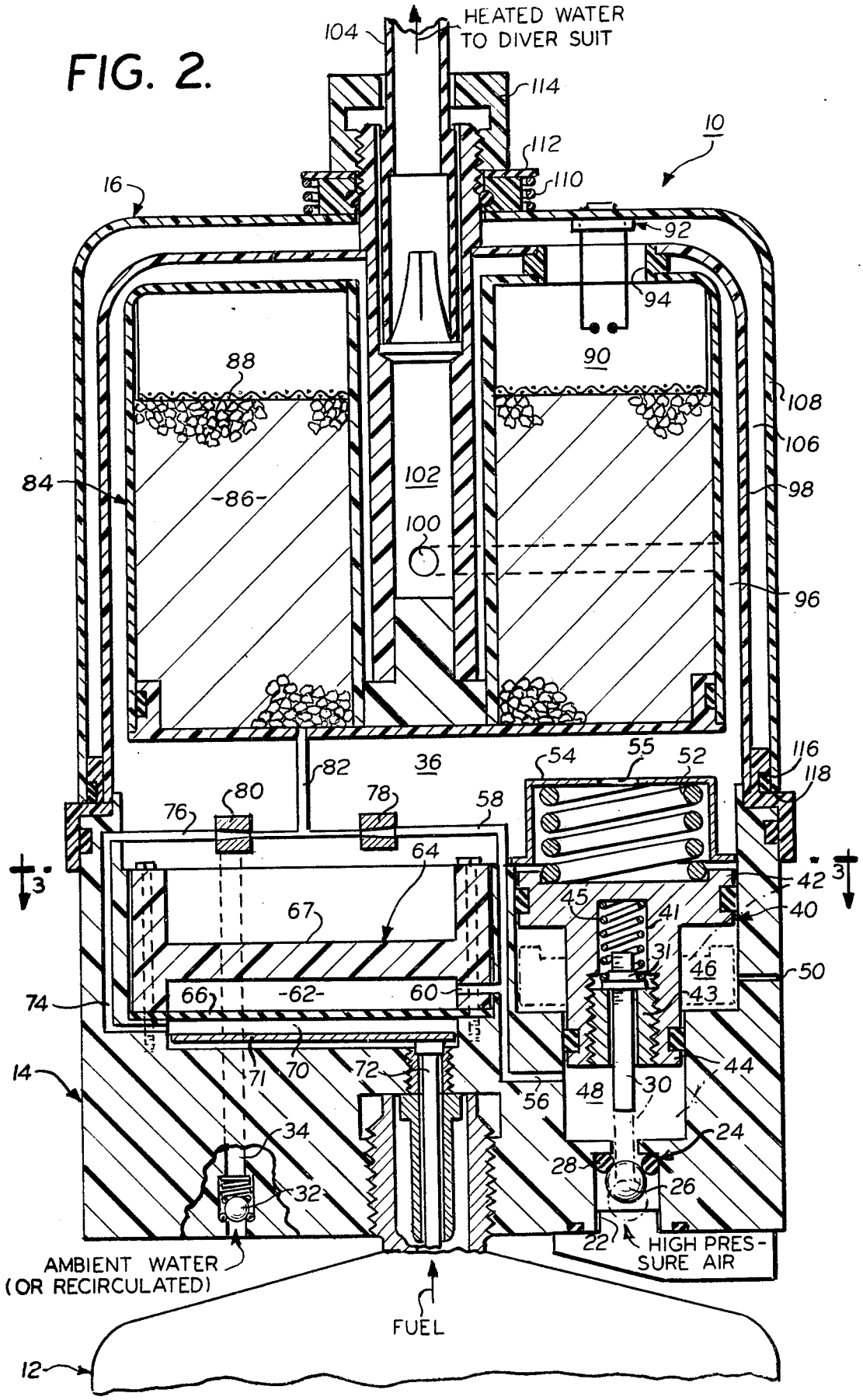
FIG. 2 is a longitudinal cross-sectional view of the diver heater assembly of FIG. 1, taken along line 2—2 of FIG. 3.

High-pressure air is fed to the preheating section 14 from the diver's scuba air tank via the conventional regulator valve 18 and passes through umbilical line 20 to air entry port 22 in preheating section 14, which as seen in FIG. 2, comprises a unitary body provided with manifold conduits, etc. The entry port 22 is provided with a valve 24, comprising valve ball 26, a resilient O-ring valve seat 28, and valve-opening pin 30 adapted to intermittently open and close to admit air to the system, as will be hereinafter described.

Ambient or recirculated water enters the preheating section 14 through check valve 32 and passage 34 to occupy a chamber 36 formed between the preheating section 14 and the combustion section 16 in a manner hereinafter described, at a pressure equal to that of the outside surrounding water.

The high pressure air valve includes a double piston 40 having a large diameter portion 42 and a smaller diameter portion 44 movable axially within chambers 46 and 48 respectively. Chamber 46 is vented to the ambient at 50. Pressure on piston 40 is exerted by spring 52, retained within springhousing 54 attached to the upper surface of the body of the peripheral section 14, as well as by the water in chamber 36 passing through one or more openings 55 in the housing. This combined force normally urges piston 40 from the solid line to the dot-dash position shown in FIG. 2. The valve pin 30, provided with a threaded upper end on which is adjustably secured a head 31, terminates in a bore 41 formed along the central axis of the piston 40. Set within the bore is a threaded plug 43 which forms a shoulder against which the head 31 engages on its downward movement. The pin 30 is biased by a spring 45 against the shoulder. The downward movement of the piston 40 in response to the bias of spring 52 and the water in chamber 36 further moves the pin 30 to displace ball 26 and to open valve 24, to admit high-pressure (125–148 PSI) air from the scuba tank into chamber 48. The inrushing air reverses the movement of piston 40, working against spring 52 and causes the larger piston portion 42 to pump against the water in chamber 36 until pin 30 permits ball 26 to reseat on ring 28 and the valve 24 to close, thus causing a flow of water to the combustion chamber.

Once valve 24 closes, the air in chamber 48, which has given up much of its high pressure by the pumping work it has accomplished on piston 40, is now pumped at a convenient pressure such as 15 psi above ambient, into passage 56, which communicates both with air line 58 and with passage 60 into chamber 62 of fuel regulator, generally given numeral 64. The fuel regulator comprises a diaphragm, formed of thin metal, rubber or the like, mounted on the edge of disk 67, having an H shape cross section, providing the recess for the chamber 62. The disk 67 is set with the larger diameter portion of a cavity formed in the body of the preheater section and is held fixedly by screws 69. The cavity is provided with a smaller diameter section 70 which communicates with the fuel inlet conduit and is provided with a freely movable (i.e. floating) plate 71 adapted to engage the stem 72 of the fuel valve. The air entering chamber 62 thus exerts a pressure against diaphragm 66, which acts agains movable plate 71 which in turn depresses the fuel valve stem 72, allowing fuel to emerge from fuel tank 12 into chamber 70 until diaphragm 66 is restored and valve stem 72 is released. The fuel in cavity 70 is thereby maintained at a pressure directly proportional to the air pressure in cavity 62. The propane fuel from chamber 70 passes through a passage 74 into fuel line 76.

Both the air in line 58 and the fuel in line 76 (both at the same pressure, although the ratio can be changed selectively by altering the proportions of fuel regulator 64) pass through respective flow restriction orifices 78, 80 adjusting the mass flow volume of each, into a common line 82 where air and fuel are mixed. This combustible mixture now enters combustion section 16. The combustion section is composed of a housing formed of an inverted double walled bowl mounted by its edges to the upper surface of the preheater section body. Within the bowl there is located an annular canister 84 defining a combustion chamber in a portion of which catalytic material 86 (such as platinized pellets) are held in place. The catalytic material is held in place by a screen 88 secured to the walls of the annulus and is spaced from the opposite end of the canister to form a space 90. Before ignition and the start of catalytic reaction, the mixed gasses after passing through the catalyst proceed to space 90 where they are ignited by spark generating device 92 (such as a conventional piezoelectric igniter). Thereafter, the gaseous products of combustion (mainly carbon dioxide and water) pass through the exhaust port 94, opening into the space between the outer bowl walls so as to be expelled from the heater system as described below.

Simultaneously, the water 36, pumped by the cyclic reciprocating movement of piston 40, is forced into the annular space 96 between canister 84 and the inner wall 98 of the housing, and between the canister 84 and central tube 102 thence through passage 100 and through the outlet tube 102 to the diver suit. The water has been heated during this journey by contact with canister 84 in which the fuel combustion takes place. The water is forced by the pumping action into umbilical line 104 directly into the diver's suit. Water is automatically replaced in chamber 36 through check valve 32 by the ambient pressure surrounding the diver which is now greater than that in the chamber 36.

The gaseous products of combustion emerging from exit port 94 of combustion chamber 84 pass into the annular space 106 between the inner wall 98 of the housing and the outer wall 108. The housing is secured as shown in FIG. 2 by spring 110, held by retaining ring 112 and connector 114 threaded to the outer end of the central rube so that its free ends are somewhat resiliently engaging the preheater housing. The pressure of the exhaust by-products of combustion distend the outer wall of the housing separating it from the seal ring 116 and escape into the ambient. The pressure on the housing created by spring 110 may be adjusted to a selected degree to permit exhaust at a predetermined pressure, but to maintain a proper seal against inflow of water into the housing. The exhaust gases held in the housing serve as an added heat source for the water in space 96.

It should be noted that the diver heater device 10 as above described will deliver heat output which varies with the depth at which the unit is operated, since at greater depth, the ambient pressure is increased, and therefore all internal pressures, which are based on the ambient, will also increase. Thus, pressures in chambers 48, 62 and 72 will be higher, the higher mass flow rates through orifices 78 and 80 will supply the air-fuel mixture to combustion chamber 84 at a faster rate and more heat will develop. This variation of heat output with depth is very desirable because of the lower water temperatures at greater depths, and because of its automatic response to depth provides an unexpected result not obtained heretofore.

The basic heat output capacity of heater system 10 may be adjusted by selection of the strength of spring 52. The effect of a stronger spring 52, as with greater depth of operation described above, will increase the pressure on chamber 48, thereby increasing pressures, mass flow rates, and heat output. However, the effect of spring 52 may also be controlled by the addition of compesatory devices. For example, if the directly proportional increase of heat output with operational depth is considered excessive for some uses, a gas-filled (e.g. air at 15 psi) bellows (not shown) may be incorporated in the system in parallel with spring 52 to act as a gas spring, decreasing the effect of higher ambient pressure on piston 40 and consequently, the pressure on chamber 48.

Figure 3:
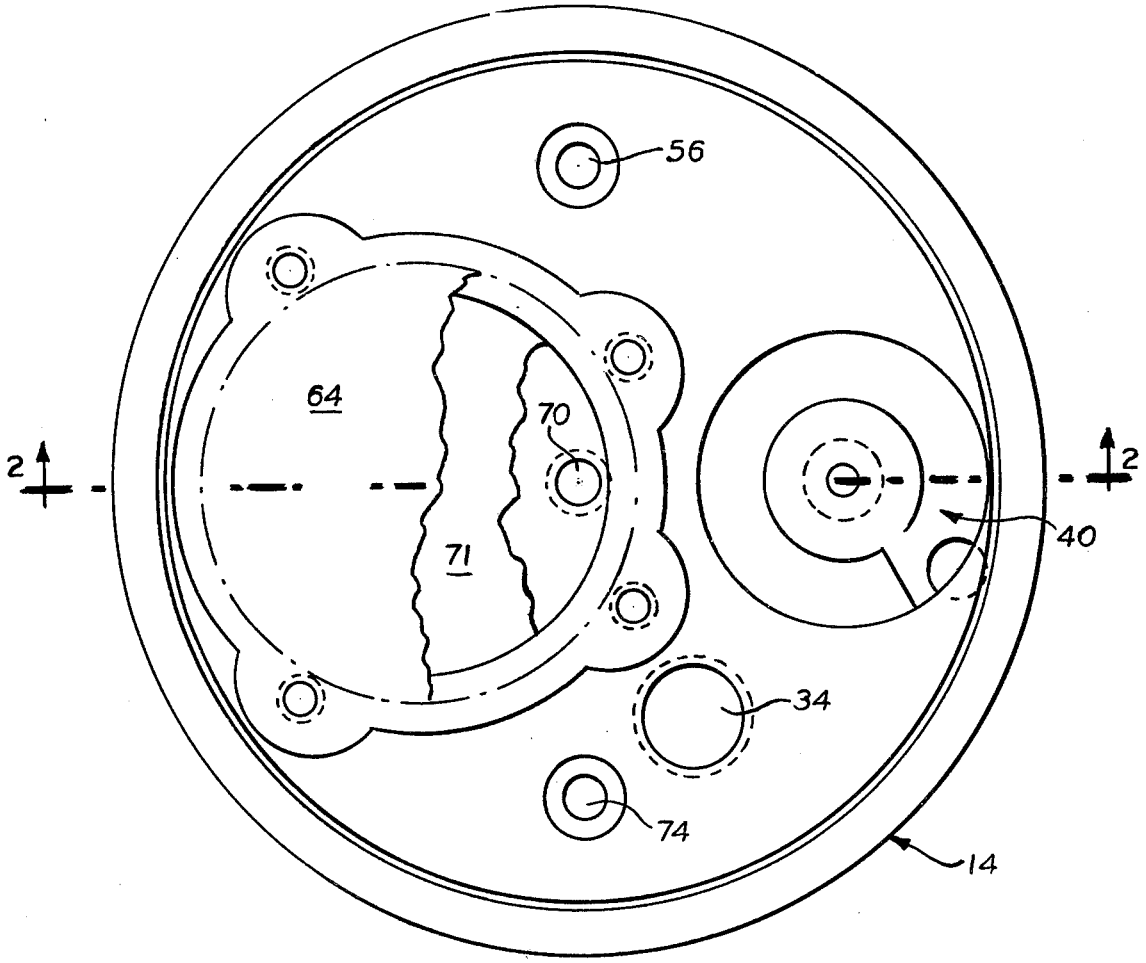
FIG. 3 is a partial cross-sectional view of the apparatus taken along line 3—3 of FIG. 2

An alternate embodiment of the air-regulating positive displacement piston pump of this invention is shown in FIG. 3. Here, the valve unit has a double piston 122 located so that its larger diameter portion 124 and its smaller diameter portion 126 may move to a greater axial extent within their respective chambers 128 and 130. A second smaller piston 132 is held in axially movable relation with bore 134 in piston 122. A light spring 136 is contained within bore 134, and resiliently holds piston 132 in sealing engagement with wall 138 of chamber 128 by means of sealing ring 140.

Ambient or recirculated water ents port 142 in preheater section 120 and fills chamber 128; high pressure air from the scuba air tank enters passage 144 of piston 132 through bore 146 into piston 122 and encounters valve ball 148. The combined air and water pressure force piston 122 to advance into chamber 130 until pin 150, held in wall 152, unseats ball 148, permitting air to enter and reverse the movement of piston 122. This causes water in chamber 128 to be pumped through exit passage 154 toward the heat-exchanger until valve ball 148 can reseat. On the next stroke of piston 122, the now reduced pressure air in chamber 130 is forced through plenum 156 and into passages 158 and 160, which lead to the fuel regulator and combustion chamber respectively.

It is to be understood that various modifications and additions may be made to the diver heater system herein described without departing from the spirit or essence of the concepts of this invention, the scope of which is defined by the appended claims.

What is claimed is:

1. A heater system for warming the body of a diver while underwater comprising a supply of air under pressure;

air intake control means for controlling the intake of air from said air supply;

a fuel storage canister;

a fuel supply in said storage canister;

fuel regulator means for controlling the intake of fuel from said fuel supply for use in the diver heater system;

water intake means for permitting the controlled introduction of water into the diver heater sytem;

pumping means for converting the high-pressure air from the air supply into reduced-pressure air for operating said air intake control means, for controlling said fuel regulator means, and for circulating water, said reduced-pressure air and said fuel;

a combustion chamber;

air-fuel conduit means for admixing said reduced-pressure air and said fuel, and for passing the resultant air-fuel mixture into said combustion chamber;

spark-generating means for igniting said resultant air-fuel mixture in said combustion chamber;

heat-exchanger means for permitting the water circulated therethrough by said pumping means to absorb the heat generated in said combustion chamber by the combustion of said air-fuel mixture; and water conduit means for passing the resultant heated water from said heat-exchanger means.

2. The diver heater system according to claim 1 including a diver underwater suit having means for the passage of water therethrough in conduction proximity to said diver's skin, said suit having means for connection to said water conduit means.

3. The diver heater system according to claim 1, which further comprises:

air flow control means for adjusting the volume of said reduced-pressure air before said reduced-pressure air enters said air-fuel conduit means; and fuel flow control means for adjusting the volume of said fuel before said fuel enters said air-fuel conduit means.

4. The diver heater system according to claim 3, further comprising means for exhausting the products of said combustion from said combustion chamber to the ambient.

5. The diver heater system according to claim 4, which further comprises:

a preheating section housing, wherein said air intake control means, said fuel regulator means, said water intake means, said pneumatic pumping means, and said air-fuel conduit means are contained, said preheating section housing being detachably connected to said fuel storage canister; and a combustion-heater-exchanger section housing, wherein said combustion chamber, said spark-generating means, said heat-exchanger means and said means for exhausting the products of said combustion are contained, said combustion-heat-exchanger section housing being detachably connected to said preheating section housing.

6. The diver heater system according to claim 5, wherein said pumping means is an air-regulating positive displacement piston pump which comprises:

said preheater section housing having a water-entrance passage leading into a water chamber, an air-entrance passage leading into an air chamber, and an intermediate air passage leading from said air chamber to both said fuel regulator means and said air flow control means;

a piston, so positioned that the air-contacting end of said piston faces into and is adapted to move axially within said air chamber, while the opposite water-contacting end of said piston faces into and is adapted to move axially within said water chamber; and a resilient biasing element, mounted so that it exerts its biasing foce against said water-contacting end of said piston;

whereby, when high-pressure air from the scuba air supply tank is introduced into said air chamber through said air-entrance passage, said piston is moved against both said resilient biasing element and the water in said water chamber, in a water-pumping direction, the high-pressure air being converted to said reduced-pressure air, whereupon said resilient biasing element moves said piston in the opposite air-pumping direction, forcing said reduced-pressure air from said air chamber, through said intermediate air passage and into both said fuel regulator means and said air flow control means.

7. The diver heater according to claim 6, wherein said air intake control means comprises:

a valve seat situated within said air-entrance passage;

a valve ball, adapted to rest on said valve seat and thereby close said air-entrance passage; and a valve-opening pin, mounted so that when said piston is moving in its air-pumping direction, said valve-opening pin displaces said valve ball from said valve seat, thus permitting high-pressure air to enter said air chamber, whereas when said piston is moving in its water-pumping direction, said valve-opening pin releases said valve ball, which returns to said valve seat, thus shutting off the high-pressure air supply.

8. The diver heater according to claim 7, wherein said valve-opening pin is resiliently mounted on said air-contacting end of said piston.

9. The diver heater according to claim 7, wherein said valve ball and said valve seat are carried in said air-contacting end of said piston, and said valve-opening pin is mounted in the wall of said air chamber which opposes said air-contacting end of said piston.

10. The diver heater system according to claim 1, further comprising combustion-catalytic material contained within said combustion chamber.

* * * * *